US007591109B2

(12) United States Patent
Rotter

(10) Patent No.: US 7,591,109 B2
(45) Date of Patent: Sep. 22, 2009

(54) RIB VENT SYSTEM FOR ROOFING PANELS

(76) Inventor: Martin J. Rotter, 115 Lismore Ave., Glenside, PA (US) 19038

( * ) Notice: Subject to any disclaimer, the term of this patent is extended or adjusted under 35 U.S.C. 154(b) by 275 days.

(21) Appl. No.: 11/109,380

(22) Filed: Apr. 19, 2005

(65) Prior Publication Data

US 2005/0229503 A1 Oct. 20, 2005

Related U.S. Application Data

(60) Provisional application No. 60/563,625, filed on Apr. 19, 2004.

(51) Int. Cl.
*E04B 7/00* (2006.01)

(52) U.S. Cl. ..... 52/198; 52/95; 52/302.7

(58) Field of Classification Search ..... 52/49, 52/57, 90.1, 198, 199, 95, 302.7, 309.13, 52/786.13
See application file for complete search history.

(56) References Cited

U.S. PATENT DOCUMENTS 1,686,118 A * 10/1928 Barrie ..... 52/302.3
2,308,942 A * 1/1943 Teasdale ..... 52/450
3,368,473 A * 2/1968 Sohda et al. ..... 454/185
3,683,785 A * 8/1972 Grange ..... 454/250
3,884,009 A * 5/1975 Frohlich et al. ..... 52/745.06
4,446,661 A * 5/1984 Jonsson et al. ..... 52/95
5,326,318 A * 7/1994 Rotter ..... 454/365
5,352,154 A * 10/1994 Rotter et al. ..... 454/365
5,596,847 A * 1/1997 Stephenson ..... 52/198
5,737,894 A * 4/1998 Simpson et al. ..... 52/520
5,867,956 A * 2/1999 Gregory et al. ..... 52/309.13
5,947,817 A * 9/1999 Morris et al. ..... 454/365
6,077,159 A * 6/2000 Clayton ..... 454/250
6,203,424 B1 * 3/2001 Gallant ..... 454/365
6,298,613 B1 * 10/2001 Coulton et al. ..... 52/199
6,913,530 B2 * 7/2005 Morris et al. ..... 454/365
6,941,706 B2 * 9/2005 Austin et al. ..... 52/94
6,955,012 B2 * 10/2005 Suzuki ..... 52/198
7,497,061 B1 * 3/2009 Isaacs ..... 52/786.13

* cited by examiner

*Primary Examiner*—Richard E Chilcot, Jr.
*Assistant Examiner*—Chi Q Nguyen
(74) *Attorney, Agent, or Firm*—Volpe and Koenig, PC

(57) ABSTRACT

A roofing system has at least one roof panel, located above the base surface, having at least one longitudinally extending projection; a gap defined between the base surface and the projection; and a venting material located within the gap that both vents the gap and prevents ingress of moisture into the gap.

6 Claims, 4 Drawing Sheets

RIB VENT SYSTEM FOR ROOFING PANELS

CROSS REFERENCE TO RELATED APPLICATION

This application claims the benefit of U.S. provisional application No. 60/563,625 filed on Apr. 19, 2005, which is incorporated by reference as if fully set forth.

FIELD OF INVENTION

This invention relates to the general field of roofing, and in particular ventilation systems for preformed roofing panels or tiles.

BACKGROUND

Preformed metal roofing panel systems provide the benefit of durability and long service life with a minimum of maintenance compared with other types of roofing systems. A typical roofing system includes preformed sheet metal panels with overlapping portions which may or may not interlock.

Each panel includes spaced longitudinal projections extending the length of the panel that provide structural rigidity and also allow mating between panels. The panels are installed on a roof such that the projections extend in the direction of the slope of the roof. The projections create gaps between the panels and any flat underlying support material or base surface on which the panels are installed. These gaps can be filled with closure strips that have a profile complementary to the bottom of the roof panel. The strips are made from a resilient watertight material at the bottom edge of the roof panels. The closure strips' installation prevents wind-driven rain, debris, or insects from entering through the gaps at the bottom edge of the roof and damaging the underlying support structure.

In order to work effectively, the closure strips must be precisely formed with complementary projections that align with the mating panel to close the gaps and prevent foreign matter from passing through to the underlying support material. A perfectly sealed roof, however, is not practicable, and inevitably, moisture finds its way between the roof panels and the underlying materials. Often, humid, warm air is trapped between roof panels and the underlying material during the day time. When the roof cools at night, moisture in the air condenses and is then trapped inside the roof structure by the closure strips. This trapped moisture may cause deterioration of the roof panels and the underlying material. Current roofing systems do not provide ventilation that assists in evaporating this unwanted water. Additionally, the known closure strips have a life of about three years before the material breaks down.

Similar problems are known in tile roofing systems, in which rounded tiles created gaps with similar problems as those discussed above.

Thus, a need exists for a panel roofing system that allows adequate ventilation between the roof panels and the underlying material to prevent deterioration of the roof panels and support material.

SUMMARY

Briefly stated, the present invention provides air permeable vent plugs located between the major projections and the base surface at a bottom end of the roof. The air permeable plugs vent an area between the roof panel and the base surface and prevent ingress of moisture and other foreign matter.

A roofing system, according to the invention, has at least one roof panel, located above the base surface, having at least one longitudinally extending projection; a gap defined between the base surface and the projection; and a venting material located within the gap that both vents the gap and prevents ingress of moisture into the gap.

DETAILED DESCRIPTION OF THE PREFERRED EMBODIMENT(S)

Figure 2A:
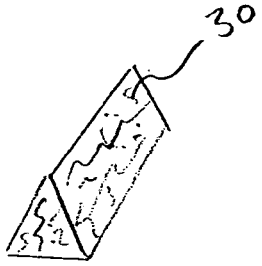
FIG. 2*a* is an isometric view of a vent plug according to a preferred embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted. The term "roof panel" is intended to refer to any type of profiled roofing media, such as profiled or corrugated metal or plastic roofing panels or roofing tiles that form a profiled roof through the assembly of multiple tiles.

The preferred embodiments of the present invention will be described with reference to the drawing figures where like numerals represent like elements throughout.

Figure 1:
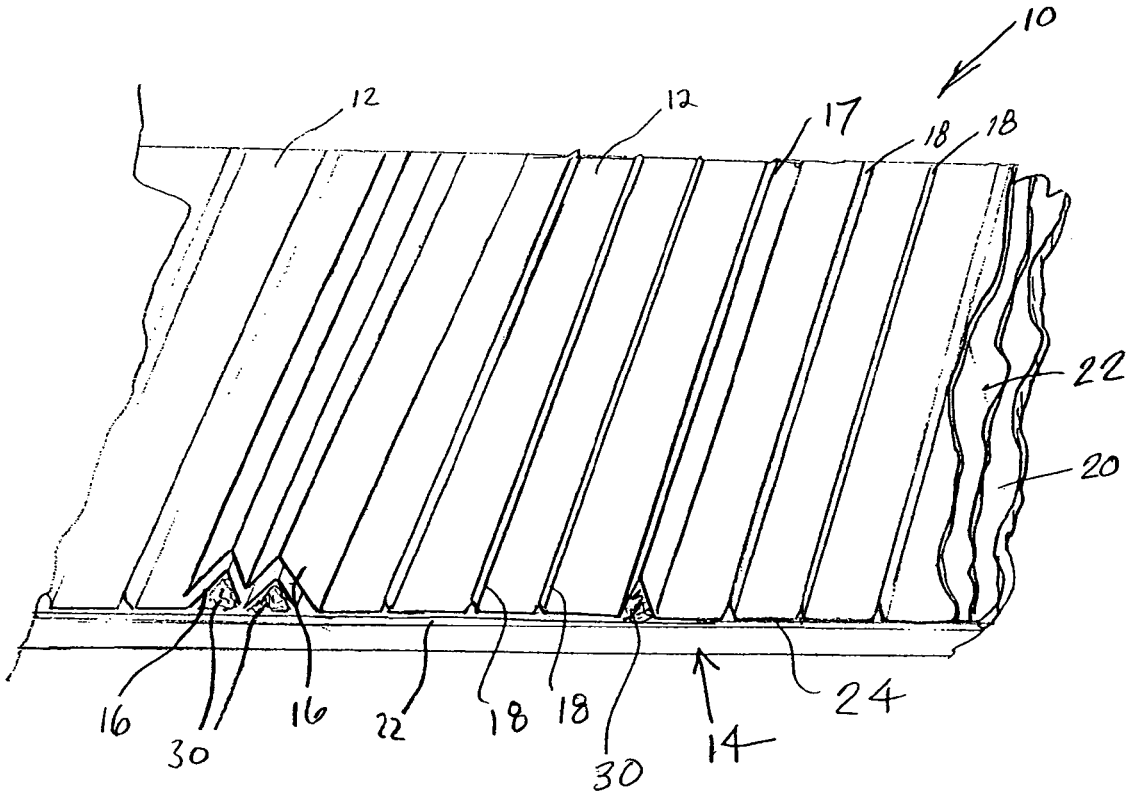
FIG. 1 is an isometric view of a roofing system according to a preferred embodiment of the present invention.

FIG. 1 shows a roofing system 10 according to a preferred embodiment of the present invention. Preformed roof panels 12 are attached to a base surface 20, preferably sheathing, of a roof 14, preferably using mechanical fasteners. The panels 12 lap each other to form a water resistant roof surface. The roof panels 12 may be formed of any suitable material, including steel, aluminum, plastic and fiberglass reinforced plastic. A water barrier 22, preferably tar paper, roofing felt or the like, is preferably disposed between the panels 12 and the base surface 20.

Each of the panels 12 may include one or more of major longitudinally extending projections 16 at the seams as well as major stiffening projections 17 and/or minor stiffening projections 18 in the field to provide structural rigidity. At a bottom end 24 of the panels 12, vent plugs 30 in accordance with a preferred embodiment of the present invention are installed in gaps formed between the major projections 16 for the seam and/or the major stiffening projections 17 and the water barrier 22. Alternatively, the plugs 30 can be installed between the major projections 16 for the seams and/or the major stiffening projections 17 and purlins used to support the roof panels. The bottom end 24 may correspond to the bottom edge of the roof structure on which the roof panels 12 are installed, or alternatively, may correspond to a transitioning portion of the roof such as a change in pitch, material or surfaces.

A first preferred plug 30 is shown in FIG. 2A. The plug 30 is preferably 2-8 inches long and is preferably comprised of a non-woven matting as described in U.S. Pat. No. 5,167,579, which is incorporated herein by reference as if fully set forth. One benefit of the vent plugs 30 made of this non-woven mesh is high UV stability and inertness, which results in the vent plugs having an installed life of fifteen (15) years or more. Alternatively, other air permeable materials could be used, such as open cell foam, which allow the flow of air while preventing the ingress of dirt, insects and moisture. The vent plugs 30 may be heat treated so that they "loft" or expand, and then calendared down to a specific size to allow the completed vent plugs 30 to expand and conform to uneven surfaces when the roof temperature rises. Preferably, the plugs 30 have a profile that matches that of the gap formed by the major projections 16, 17 and are sized to have an interference fit between the major projections 16, 17 and the base surface 20.

Figure 2B:
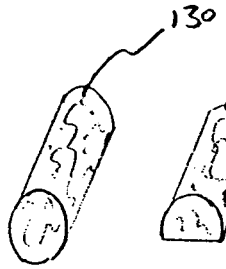
FIG. 2*b* is an isometric view of another vent plug according to a preferred embodiment of the present invention.
Figure 2C:
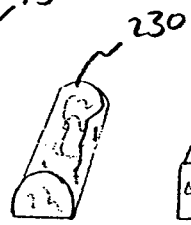
FIG. 2*c* is an isometric view of another vent plug according to a preferred embodiment of the present invention.
Figure 2D:
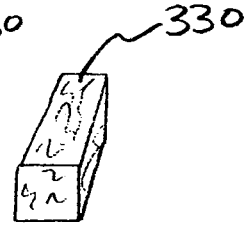
FIG. 2*d* is an isometric view of another vent plug according to a preferred embodiment of the present invention.

In the embodiment shown in FIGS. 1 and 2A, the gaps formed by the major projections 16, 17 and the plugs 30 are triangular prisms. Alternatively, the major projections 16, 17 and the plugs 30 may take on any suitable form including that of another type of polygonal prism or a non-polygonal prism. Also, the plugs 30 need not have the same shape as that of the mating gaps formed by the major projections 16, 17. The material forming the plugs 30 is preferably sufficiently deformable to allow one type of plug 30 having a given shape to be used with multiple different projection profiles commonly found on roofing panels 12. FIGS. 2B-2D show other preferred configurations in the form of a cylindrical plug 130, semi-cylindrical plug 230 (which could be used with a rounded tile roof such as that shown in FIG. 8), and a rectangular prism shaped plug 330, respectively, according to preferred embodiments of the present invention. Those skilled in the art will understand from the present disclosure that other shapes and/or cross-sections could be used.

The plugs 30 may include a tapered end to facilitate installation. Installation of the plugs 30 is accomplished after the panels 12 are secured on the base surface 20. The plugs 30 are inserted, preferably tapered end first, into a respective gap of one of the major projections 16, 17 so that an end of each plug is flush, slightly recessed, or slightly protruding with respect to the roof end 24. Optionally, the vent plugs 30 may be adhered to the panels 12 and/or the water barrier 22 by an adhesive applied to at least one of the plugs 30, the panels 12 and the water barrier 22. The adhesive may include a fluid or semi-solid substance, or alternatively, the adhesive may include adhesive strips, of the type known in the art, supplied pre-attached along a lower surface of each of the vent plugs 30. The adhesive strips preferably include a release strip which, when removed, reveals an adhesive such as an acrylic or silicone.

Figure 4:
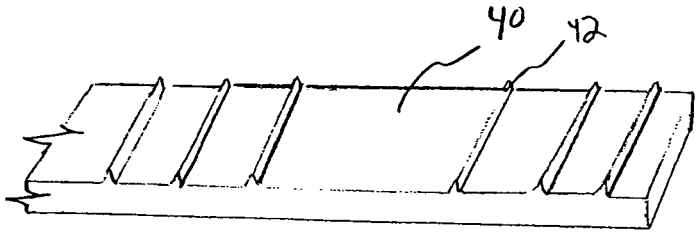
FIG. 4 is an isometric view of a closed cell foam closure strip according to a preferred embodiment of the present invention.
Figure 3:
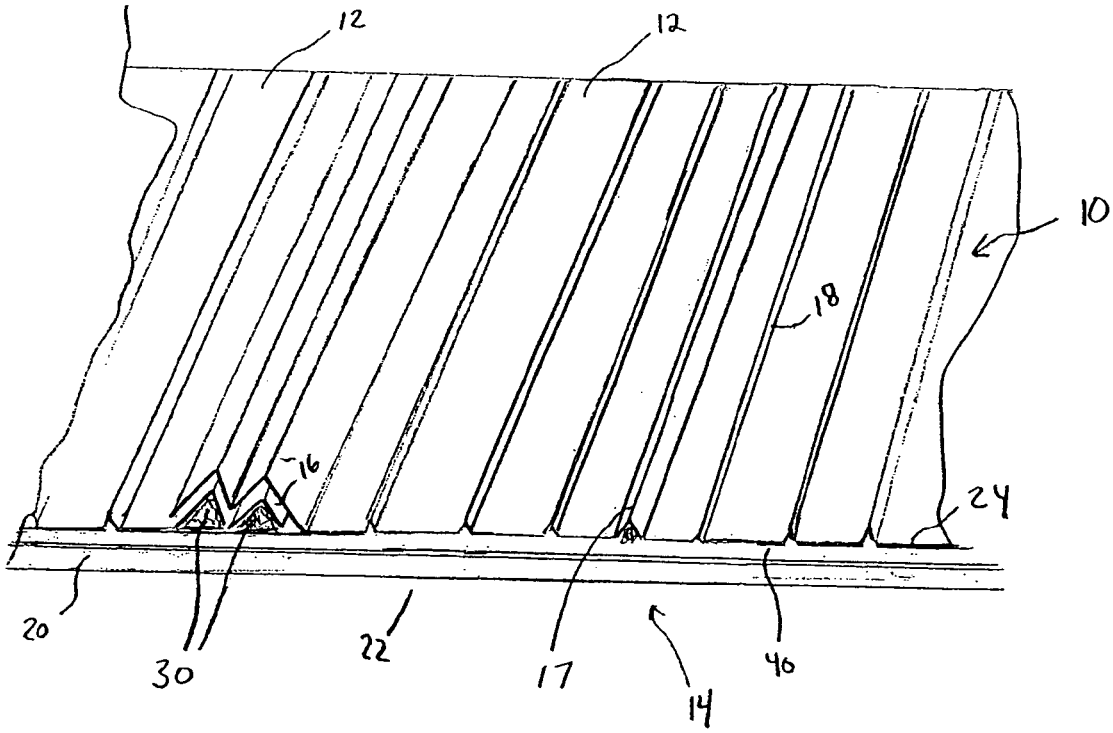
FIG. 3 is an isometric view of another roofing system according to a preferred embodiment of the present invention.
Figure 6:
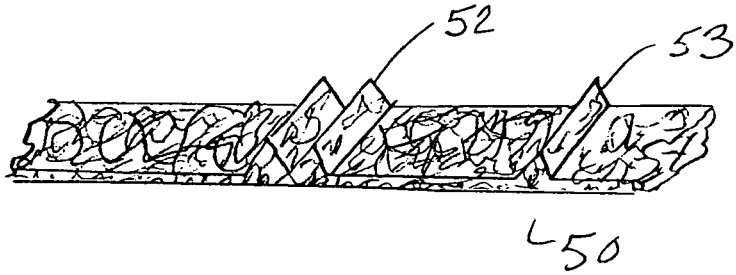
FIG. 6 is an isometric view of a vent closure strip according to a preferred embodiment of the present invention.
Figure 5:
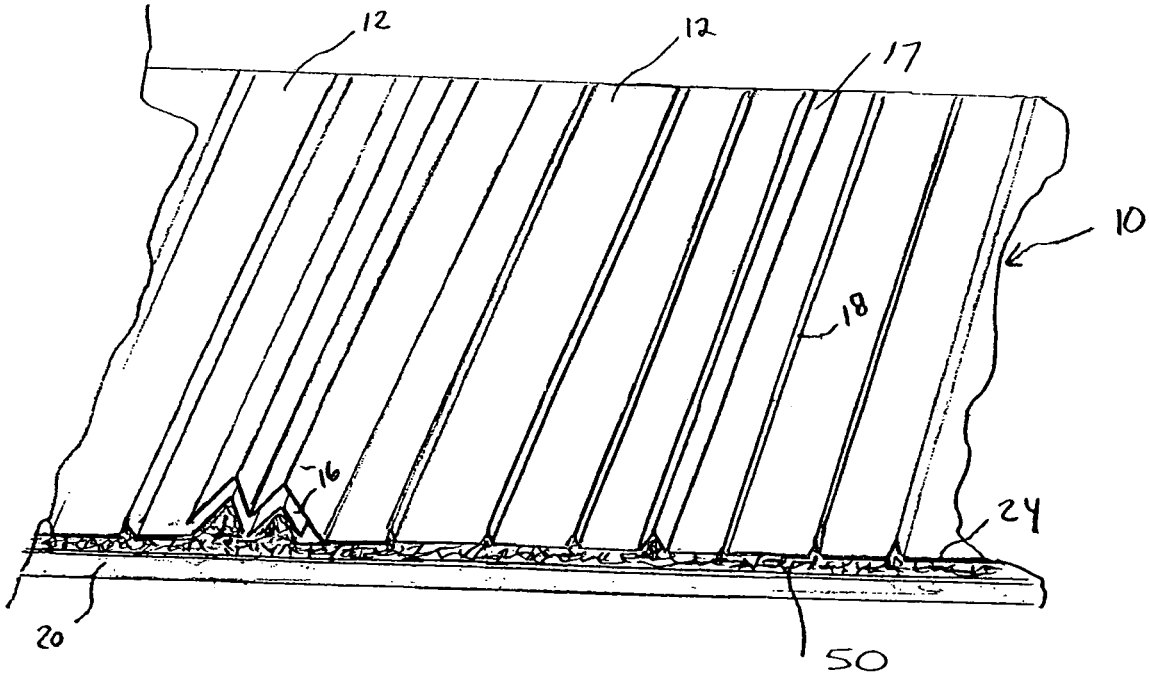
FIG. 5 is an isometric view of another roofing system according to a preferred embodiment of the present invention.

Referring now to FIGS. 3 and 4, another preferred embodiment of the invention is shown. In this embodiment, a closed cell foam closure strip 40, is installed on the water barrier 22 at the roof end 24, and the panels 12 are installed on top of the closure strip 40. The closure strip 40 preferably includes ribs 42 corresponding to the minor projections 18, and may also include a self-adhering back or face to facilitate installation. Alternatively, the ribs 42 are omitted and the foam closure strip 40 is sufficiently compressible to allow gaps formed by the minor projections 18 to be filled by the closure strip 40. The closure strip 40 is preferably ½" to 8" wide and at least ⅛" thick. EPDM, neoprene, polyethylene, polyurethane, PVC, vinyl, nitrile or any suitable moisture and weather resistant material may be used to fabricate the closure strip 40. In this embodiment, the vent plugs 30 are installed after the installation of the roof panels 12 in the same manner as described above with reference to FIG. 1. Each of the vent plugs 30 is inserted into a gap between one of the major projections 16, 17 and the closure strip 40 so that an end of each plug is flush, slightly recessed or slightly protruding with respect to the roof end 24. The plugs 30 may be shorter than the width of the closure strip 40, or alternatively, longer than the width of the closure strip 40 causing them to overhang. An adhesive may be used to connect the plugs 30 to the panels 12 and/or the closure strip 40. If the plugs 30 overhang the closure strip 40, the plugs may also be adhered to the water barrier 22.

FIGS. 5-8 show two other preferred embodiments of the present invention. In the embodiment shown in FIGS. 5 and 6, a venting closure strip 50 includes mating projections 52, 53 that correspond to the major projections 16, 17 of the roof panels 12. The strip 50 is preferably fabricated of a non-woven matting as described above with respect to the plugs 30; however, other suitable air permeable materials can be used, such as an open cell foam. The venting closure strip 50 is installed over the water barrier 22 at the roof end 24, and the roof panels 12 are installed on top of the strip 50. The strip 50 may be fabricated to match the profile of the mating panels 12, or alternatively, may be fabricated to approximate the profile. Even if the strip 50 and panels 12 have somewhat dissimilar profiles, the elasticity of the venting closure strip 50 allows the forming of a closure at the roof end 24 to prevent water and debris from entering between the water barrier 22 and the panels 12, while still allowing ventilation under the roof panels 12. This elasticity also ensures closure if the panels 12 or strip 50 are somewhat misaligned. Adhesives may be used in the installation process to adhere the strip 50 to the water barrier 22 and/or the panels 12.

Figure 8:
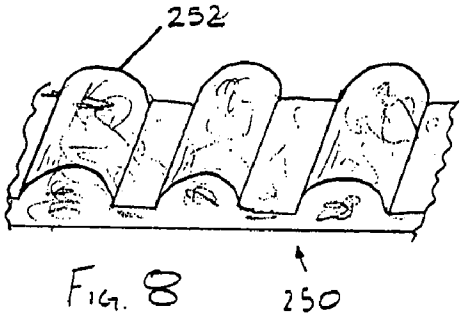
FIG. 8 is an isometric view of a vent closure strip according to a preferred embodiment of the present invention.
Figure 7:
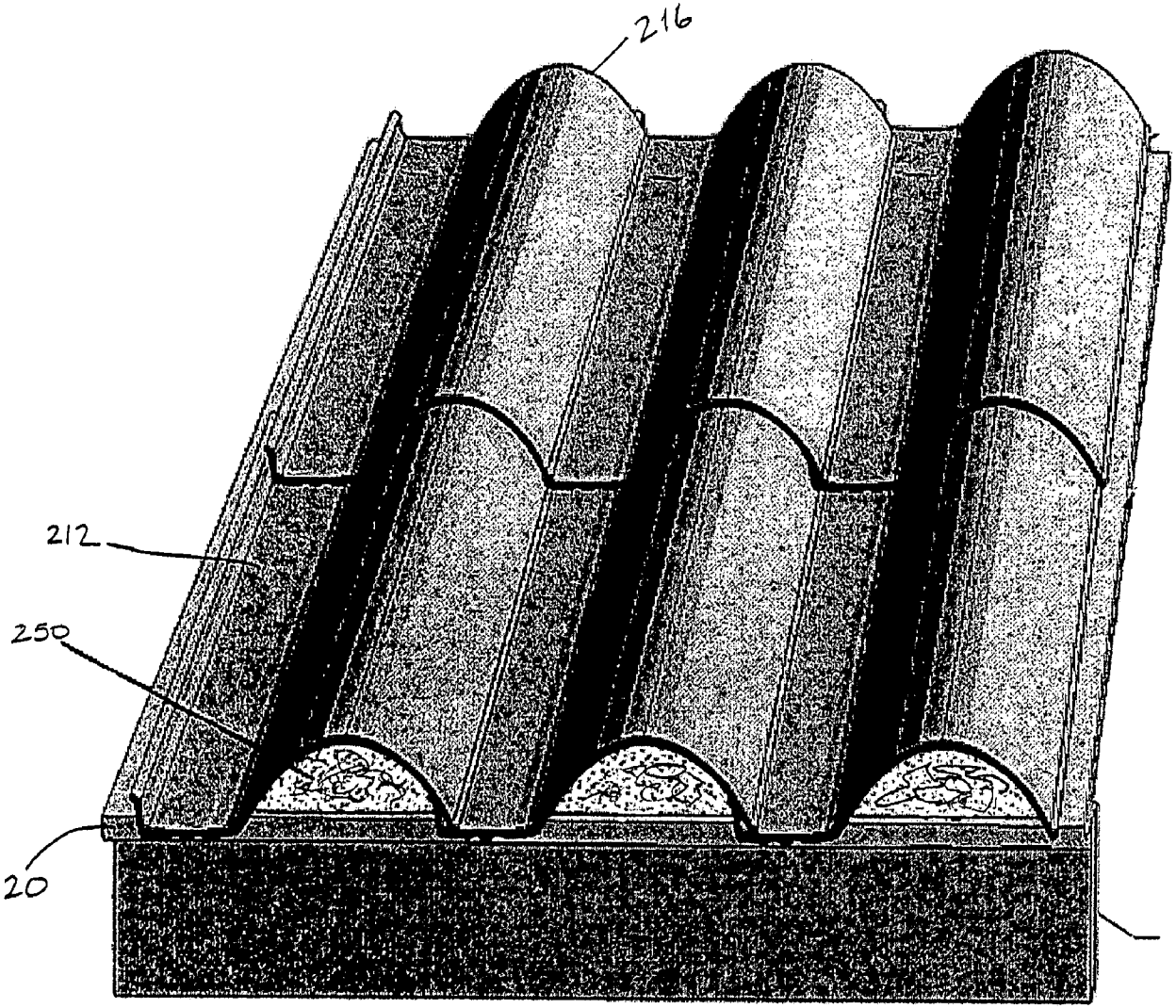
FIG. 7 is an isometric view of a roofing system according to a preferred embodiment of the present invention.

In the embodiment shown in FIGS. 7 and 8, a venting closure strip 250 includes mating projections 252 that correspond to the major projections 216 of roof tiles 212 used to construct a tile roof. The strip 250 is preferably fabricated of a non-woven matting or open cell foam as described above. The venting closure strip 250 is installed as above, with the advantages and modifications as discussed with respect to the venting closure strip 50. Alternatively, individual plugs 230, such as shown in FIG. 2C, having a complementary profile to the tiles, could be used.

Those skilled in the art will recognize that the vent plugs 30, 130, 230, 330 can be used at some or all of the major projections 16, 17, and 216. Additionally, if the strips 50 or 250 are used, the mating projections 52, 53, and 252 can be at some or all of the major projection locations in the roof panel 12 or tile 212.

While the preferred embodiments of the invention have been described in detail, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A roofing system for use on a base surface of a roof comprising:

at least one roof panel, located above the base surface, having at least one longitudinally extending projection that extends to a bottom edge of the roof, a gap is defined by within the at least one longitudinally extending projection and located between the base surface and an interior surface of the projection facing the base surface, and a venting material located within the gap at the bottom edge of the roof that both vents the gap and prevents ingress of moisture into the gap, the venting material comprising a venting closure strip located between the roof panel and the base surface, the venting closure strip comprising at least one rib that conforms to a shape of the gap and at least two valleys of lower cross-sectional profile than the rib, one on either side of the rib.

2. A roofing system for use on a base surface of a roof comprising:

at least one roof panel, located above the base surface, having at least one longitudinally extending projection that extends to a bottom edge of the roof, a gap is defined by within the at least one longitudinally extending projection and located between the base surface and an interior surface of the projection facing the base surface, and a venting material located within the gap at the bottom edge of the roof that both vents the gap and prevents ingress of moisture into the gap, the venting material comprising a venting closure strip located between the roof panel and the base surface, the venting closure strip comprising at least one rib that shaped to fit within the gap and at least two valleys of lower cross-sectional profile than the rib, one on either side of the rib.

3. The roofing system of claim 2, wherein the rib expands within the gap.

4. The roofing system of claim 2, wherein the rib fits within the gap in an interference fit.

5. The roofing system of claim 2, wherein the rib is larger in shape than the gap.

6. A method for venting an area between a roof panel and a base surface of a sloped roof, the method comprising inserting a venting material between an interior surface of longitudinally extending projection on the roof panel and the base surface of the roof at a gap; wherein the gap is defined by within the longitudinally extending projection, wherein the venting material is an air permeable plug or a venting closure strip comprising at least one rib that shaped to fit within the gap and at least two valleys of lower cross-sectional profile than the rib, one on either side of the rib.

* * * * *